US009762003B2

(12) United States Patent
Ludwig et al.

(10) Patent No.: US 9,762,003 B2
(45) Date of Patent: Sep. 12, 2017

(54) NETWORK CONNECTOR ASSEMBLY AND SYSTEM FOR VEHICLES

(71) Applicant: Delphi Technologies, Inc., Troy, MI (US)

(72) Inventors: Martin Ludwig, Wuppertal (DE); Michael Rucks, Schwerte (DE); Detlef Wiese, Ennepetal (DE); Jean Razafiarivelo, Rambouillet (FR); Yves Stricot, Villepreux (FR)

(73) Assignee: DELPHI TECHNOLOGIES, INC., Troy, MI (US)

( * ) Notice: Subject to any disclaimer, the term of this patent is extended or adjusted under 35 U.S.C. 154(b) by 0 days.

(21) Appl. No.: 15/335,948

(22) Filed: Oct. 27, 2016

(65) Prior Publication Data

US 2017/0125951 A1 May 4, 2017

(30) Foreign Application Priority Data

Oct. 29, 2015 (EP) ..... 15192011

(51) Int. Cl.

| | |
|---|---|
| ***H01R 12/00*** | (2006.01) |
| ***H01R 13/659*** | (2011.01) |
| ***H01R 13/6596*** | (2011.01) |
| ***H01R 13/514*** | (2006.01) |
| ***H01R 12/72*** | (2011.01) |

(52) U.S. Cl.

CPC ..... *H01R 13/659* (2013.01); *H01R 12/724* (2013.01); *H01R 13/514* (2013.01); *H01R 13/6596* (2013.01)

(58) Field of Classification Search

CPC .. H01R 13/659; H01R 12/724; H01R 13/514; H01R 13/6596

USPC ..... 439/78

See application file for complete search history.

(56) References Cited

U.S. PATENT DOCUMENTS

| | | | | |
|---|---|---|---|---|
| 8,308,512 | B2 * | 11/2012 | Ritter | H01R 12/724 439/607.18 |
| 8,668,522 | B2 * | 3/2014 | Becker | H01R 13/514 439/607.02 |
| 2003/0186595 | A1 | 10/2003 | Provencher et al. | |
| 2012/0184138 | A1 * | 7/2012 | Davis | H01R 12/724 439/607.3 |
| 2015/0104977 | A1 | 4/2015 | Hamner et al. | |

FOREIGN PATENT DOCUMENTS

| | | | |
|---|---|---|---|
| EP | 2390961 | A1 | 11/2011 |

* cited by examiner

*Primary Examiner* — Jean F Duverne
(74) *Attorney, Agent, or Firm* — Robert J. Myers

(57) ABSTRACT

The invention relates to a network connector assembly for vehicles. The network communicates at data rates of 100 Mbit/s and/or 1 Gbit/s. The connector assembly includes a header having at least two pins forming a pin pair. The pins extend in a mating direction. The connector assembly also includes an electrically conductive shielding member shielding the pin pair on at least two sides. The shielding member has a front face that is oriented substantially normal to the mating direction. The connector assembly further includes a header shroud, wherein the header shroud is provided with a shielding cavity for receiving the shielding member. The front face of the shielding member is at least partly covered by the header shroud.

15 Claims, 8 Drawing Sheets

NETWORK CONNECTOR ASSEMBLY AND SYSTEM FOR VEHICLES

CROSS-REFERENCE TO RELATED APPLICATION

This application claims the benefit under 35 U.S.C. §119 (a) of Patent Application No. 15192011.3 filed in the European Patent Office on Oct. 29, 2015, the entire disclosure of which is hereby incorporated by reference.

TECHNICAL FIELD OF THE INVENTION

The invention relates to a network connector assembly, a corresponding counter connector assembly and a network connector system in particular for vehicles, wherein the network connector assembly is suitable for networks communicating at data rates at 100 Megabits per second (Mbit/s) and/or 1 Gigabit per second (Gbit/s).

BACKGROUND OF THE INVENTION

In recent years, vehicles have been equipped with numerous on board electronics. These on board electronics provide a wide field of functionality, such as sensors, control functions and the like. For data communication between single on board electronic components, data networks have been established within vehicles. These data networks are, for example, based on Ethernet operating at data rates up to 100 Mbits/s or 1 Gbit/s.

With providing new on board electronics, the need for higher data rates increases. However, the higher the data rate, the higher is the crosstalk level, particularly if connectors and/or cables of single data signal paths are arranged adjacent to each other. Further, with increasing data rates, the EMC properties (electromagnetic compatibility) of the connectors used decreases. Thus, different connectors are provided for 100 Mbit/s networks and 1 Gbit/s networks. To overcome increased crosstalk and reduced EMC properties at data rates up to 1 Gbit/s, the distance between single connectors has been increased. Thus, these connectors need more space, when collected, or have to be placed farther from each other. Since the smaller 100 Mbit/s connectors are still used (e.g. for space requirements), two different connector types are established. However, different connector types lead to an increased number of parts and increased manufacturing and storage costs.

Thus, there is the need in the art to provide a network connector that is suitable to transfer signals with data rates of at least 1 Gbit/s having reduced space requirements and good crosstalk and EMC properties.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

An electrical terminal for a female connector, is presented herein. The terminal includes at least one contact blade having a first sheet plane. The contact blade is configured to contact an electrical pin with a contact force when the terminal is mated with the electrical pin; and at least one separate support blade having a second sheet plane. The support blade engages with a corresponding contact blade to increase the contact force, and wherein the first and second sheet planes are orientated substantially perpendicular to each other.

The above-described drawbacks are at least partly overcome by a network connector assembly for vehicles, wherein the network communicates at data rates between 100 Mbit/s and 1 Gbit/s, and wherein the connector assembly includes a header, having at least two pins forming a pin pair, wherein the pins extend in a mating direction; an electrically conductive shielding member, shielding the pin pair on at least two sides, wherein the shielding member has a front face that is orientated substantially normal to the mating direction; and a header shroud, wherein the header shroud is provided with a shielding cavity for receiving the shielding member, wherein the front face of the shielding member is at least partly covered by the header shroud.

Those network connector assemblies allow data transmission at data rates between 100 Mbit/s and 1 Gbit/s, while using one type of connector with reduced crosstalk. Ethernet protocol may be used. The header may be formed of an insulating material such as plastic, wherein the at least two pins are formed from an electrically conductive material such as metal.

The header supports the pins mechanically and provides a defined distance between the pins. The pin pair that is formed by two adjacent pins is used for data transmission. Thereby, the pins have one mating portion that is configured to be mated with a corresponding terminal of a counter connector. The opposite side of the pin is a contact portion that is used to contact the pin to another electrically conductive member, such as a printed circuit board (PCB) or a wire. The mating portion and the contact portion of a pin can be provided in a line so that the pin is substantially linear, i.e. the pin is not angled. The pins may be provided with a bending angle, wherein the bending angle is in the range of 30°-120°, more preferably in the range of 50°-110° and most preferably in the range of 85°-95°. Thus, angled network connector assemblies can be provided that can be adjusted to space requirements in a vehicle. To reduce crosstalk between two adjacent pin pairs and/or other data communication members in the environment of a pin pair, a shielding member is provided that shields the pin pair on at least two sides.

It has shown that a two-sided shielding member provides good crosstalk properties so that the network connector assembly can be used up to data rates of at least 1 Gbit/s. Thereby, the front face of the shielding member is orientated substantially normal to the mating direction, so that the shielding member is at least partly parallel to the pins of the pin pair.

Still further, a header shroud is provided. The header shroud is typically formed of an electrical insulator such as plastic and is provided to protect the pins and/or the shielding member from damages. Further, the header shroud provides high mechanical stability so that the network connector assembly can be mated with a corresponding counter connector assembly without being damaged. Thus, the header shroud is typically provided with at least one opening that receives the pin pair. Further, the header shroud is provided with a shielding cavity that is different from the opening that receives the pin pair. The shielding cavity may have no through hole, so that the shielding member is at least partly covered by the header shroud on its front face. This will lead to an improved mechanical stability, so that the shielding member and the pins are protected by the header shroud. Therefore, the risk of damaging the network connector assembly during transportation, mating and installation in a vehicle is significantly reduced.

The shielding member may include at least two first shielding plates, wherein the at least one pin pair is provided between the two first shielding plates so that the shielding member shields the pin pair on at least two sides, and wherein each of the two first shielding plates is spaced apart from a corresponding pin of the pin pair by an equal distance $x_s$, wherein the distance is preferably at most 3.5 mm, even more preferably at most 3 mm and most preferably at most 2.5 mm.

Providing a shielding plate that is assigned to a specific pin of a pin pair and positioned in a distance $x_s$ from the pin pair, has shown to provide an efficient crosstalk reduction. By providing each shielding plate at an equal distances from an assigned pin of the pin pair, a symmetrical shielding arrangement is achieved that leads to significantly reduced crosstalk, even under high data rates of at least 1 Gbit/s.

The shielding member may further include at least one second shielding plate, wherein the at least one second shielding plate shields the at least one pin pair on a third side and/or on a fourth side. Thus, the shielding member or at least a portion of the shielding member that partly surrounds the pin pair is U-shaped when seen from the front face or encircles the pin pair entirely, if two second shielding plates are used. Providing additional second shielding plates further increases the shielding properties and reduces crosstalk. Still further, by providing second shielding plates the mechanical stability of the shielding member can be increased and damages can be prevented. With providing second shielding plates, the overall length of the shielding member in the mating direction can be reduced.

The network connector assembly may include at least two pin pairs, preferably at least six pin pairs and most preferably at least eight pin pairs, wherein the pin pairs are arranged in at least one row and wherein at least one first shielding plate is arranged between two adjacent pin pairs, so that each first shielding plate is spaced apart from a corresponding pin of a pin pair by an equal distance $x_s$.

The values for the distance $x_s$ may be the same as described above. By providing multiple pin pairs, the number of on board electronic components in a vehicle can be easily increased, since multiple data transmission paths can be connected simultaneously by using the network connector assembly. Therefore, manufacturing time and costs can be reduced.

By providing first shielding plates that are arranged between two adjacent pins at an equal distance $x_s$, each pin has the same shielding environment, and therefore, crosstalk can be significantly reduced. Between two adjacent pin pairs that are arranged in a row, at least one first shielding plate is arranged. That means that the one shielding plate is assigned to two pins of different pin pairs and can be arranged between two adjacent pin pairs.

The network connector assembly may include multiple pin pairs, wherein the pin pairs are arranged in rows and columns and wherein the shielding member further includes at least one second shielding plate that is provided, preferably centered, between two adjacent rows. With providing a second shielding plate between two adjacent rows, crosstalk between two adjacent pin pairs of different rows can be reduced. Further, by centering the second shielding plate between the two adjacent rows, every pin of a pin pair can be provided with similar shielding properties, so that the crosstalk reduction can be achieved for every pin pair of the different rows, in the same manner.

The distance $x_p$ between two pins of a pin pair may be in the range of 1.4 mm to 2.1 mm and is preferably 1.8 mm; and wherein the distance $x_c$ between two adjacent pins of different pin pairs in a row may be in the range of 5.0 mm to 6.5 mm and is preferably 5.4 mm; and wherein preferably the distance $h_r$ between two adjacent pins of different pin pairs in a column is in the range of 3.3 mm to 5.3 mm and is preferably 3.6 mm. These dimensions have shown to provide a network connector assembly having small space requirements and being suitable for data transmission at data rate of at least 1 Gbit/s with reduced crosstalk.

The first shielding plates may extend beyond the second shielding plate in the mating direction and/or in a direction opposite to the mating direction. It has surprisingly shown that the first shielding plates that extend beyond the second shielding plate lead to a significant reduction of crosstalk. If angled pins are provided, the second shielding plate can be angled in the same manner as the pins, so that the pin pairs are shielded on the third and/or fourth side along the entire length of the pins. Further, providing first shielding plates that extend beyond the second shielding plates in a direction opposite to the mating direction will further reduce crosstalk.

The shielding member may be integrally formed. Thus, the shielding member can be manufactured from a single metal sheet that is bent accordingly. Alternatively, the first and second plates of the shielding member can be separate parts that are assembled to form the shielding member. Still further, the shielding member can be formed from a conductive plastic material and can be molded or extruded as an integrally formed shielding member. Thus, the shielding member may be formed of a metal sheet and/or an electrically conductive polymer.

Suitable metals or alloys can include any of aluminum, copper, steel, zinc and the like. An electrically conductive polymer can be an organic polymers or any other polymer having a polymer matrix that may be filled with electrically conductive fillers, such as metal particles. These electrically conductive polymers can easily be formed with known polymer processing techniques, such as injection molding, extrusion and/or the like and can be formed to very complex shielding members. The header shroud may be integrally formed with the shielding member. Thus, manufacturing of the network connector assembly is simplified.

The header is molded on the shielding member, wherein the header may be integrally formed with the header shroud. Over molding the shielding member at least partly with the header leads to increased mechanical stability and a strong connection between the header and the shielding member. Further, the header surrounds the shielding member at least partly so that the shielding member is protected from environmental influences by the header. Further, the header can be integrally formed with the header shroud so that the number of parts is reduced and manufacturing costs can be reduced.

The shielding cavity of the header shroud may be provided with at least one through hole for electrically contacting the shielding member with a counter shielding member of a corresponding counter connector assembly, upon mating the network connector assembly with the corresponding counter connector assembly. Thus, a continuous shielding can be provided over the mated connector. This will lead to significantly reduced crosstalk and further will increase the EMC properties of the connector assembly.

The network connector assembly may be mounted on a printed circuit board, wherein the shielding member includes a contacting member for electrically conductive contacting the shielding member with the printed circuit board. Providing a contacting member that can be contacted with, e.g. the ground plane of a painted circuit board will further reduce crosstalk and increase the EMC properties. The contacting member can e.g. be formed as a solder pin, a bonding surface or can be glued electrically conductive to the PCB.

The drawbacks discussed above are at least partly overcome by a counter connector assembly, wherein the counter connector assembly is configured to be mated with the network connector assembly as described above and wherein the counter connector assembly includes at least one counter connector having at least two contact terminals; a collector housing being configured to receive at least one counter connector; and an electrically conductive counter shielding member, wherein the counter shielding member is arranged within the collector housing so that the counter connector is shielded on at least two sides by the counter shielding member.

The counter connector having at least two contact terminals and is configured to be connected with a pin pair of the connector assembly. Thus, if multiple pin pairs are provided, the counter connector assembly is also provided with multiple counter connectors. The collector housing thereby serves to arrange the multiple counter connectors according to the arrangement of the pin pairs. Thus, the collector housing provides corresponding distances between the rows and columns of the counter connectors as of the network connector assembly. Further, the terminals of the counter connector have the same distance as the pins of the pin pairs. By providing a collector housing, multiple counter connectors can be simultaneously connected to the network connector assembly. A single counter connector can be unmated or replaced after the counter connector assembly has been mated to the network connector assembly. The electrically conductive counter shielding member reduces crosstalk even under high data rights of at least 1 Gbit/s.

The counter shielding member may include at least one shielding element, wherein the shielding element includes at least two first counter shielding plates and wherein the counter connector is positioned between the two first counter shielding plates, so that the shielding element shields the counter connector on at least two sides, and wherein the shielding element further includes at least one second counter shielding plate, wherein the at least one second counter shielding plate shields the at least one counter connector on a third side and/or on a fourth side.

Thus, each counter connector is provided with similar shielding conditions so that crosstalk can be significantly reduced. Further, the counter shielding member is formed of a metal sheet and/or an electrically conductive polymer, wherein the shielding element and/or the counter shielding member may be integrally formed.

If metal sheets are provided to form the counter shielding member, conventional bending techniques can be used. The use of electrically conductive polymers, as described above, allows to provide integrally formed shielding members or shielding elements that may have complex forms. Still further, single shielding elements can be provided that are assigned to single counter connectors or to a defined number of counter connectors. A single shielding element may be used with at least one counter connector, at least two counter connectors, and/or at least four counter connectors.

Further, these shielding elements can be integrally formed as a counter shielding member. Providing counter shielding elements allows to use the same elements for different counter connector assembly configurations. For example, if the counter connector assembly includes an even number of counter connectors, a shielding element that is assigned to two counter connectors is advantageous, since a corresponding number of shielding elements can be provided for different configurations of counter connector assembly.

The drawbacks are further at least partly overcome by a network connector system, wherein the network connector system includes a network connector assembly and a counter connector assembly as described above, wherein the network connector system is an Ethernet network connector system configured to transmit data at a data rate of at least 100 Mbit/s to 1 Gbit/s. Thus, the network connector assembly and the counter connector assembly can be used for 100 Mbit/s networks and for 1 Gbit/s networks so that the number of different parts in the vehicle manufacturing can be reduced.

The shielding member and the counter shielding member of the network connector system may not overlap when the network connector system is mated. This allows to provide the shielding members entirely within the header shroud and/or the collector housing to provide increased mechanical stability. Further, the shielding members are protected from environmental influences, so that the overall lifespan of the network connector system can be increased.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1A:
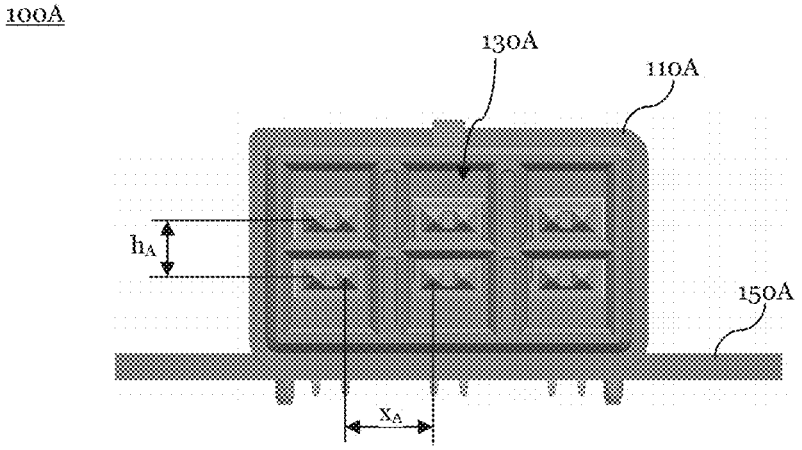
Fig. 1A (Prior Art)
FIG. 1A is a schematic front view of a conventional 100 Mbit/s network connector assembly.
Figure 1B:
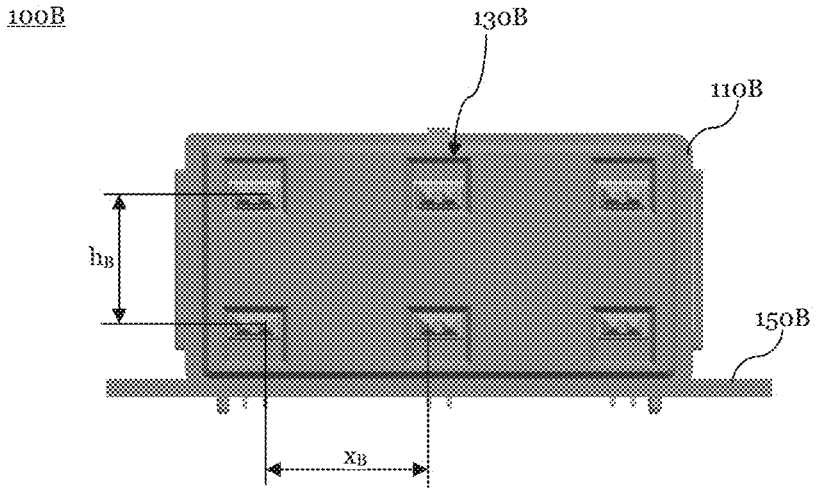
Fig. 1B (Prior Art)
FIG. 1B is a schematic front view of a conventional 1 Gbit/s network connector assembly.

In particular, FIG. 1A and FIG. 1B show network connector assemblies according to the prior art, wherein the network connector assembly 100A of FIG. 1A is configured to transmit data at a data rate of 100 Mbit/s and wherein the network connector assembly 100B of FIG. 1B is configured to transmit data at data rates of 1 Gbit/s. The network connector assembly is mounted on a PCB 150A, 150B and includes a header shroud 110A, 110B, wherein multiple pin pairs 130A, 130B are arranged. As can be seen from the comparison of FIG. 1A and FIG. 1B, the distance between two adjacent rows of the counter connector assemblies 100A, 100B is different. The distance between two adjacent rows $h_A$ of the network connector assembly 100A is smaller than the distance $h_B$ of the network connector assembly 100B. Similarly is the distance $x_A$ between two adjacent columns of the network connector assembly 100A smaller than the distance between two adjacent columns $x_B$ of the network connector assembly 100B. The larger distances $h_B$ and $x_B$ in the network connector assembly 100B are necessary to avoid crosstalk when higher data rates are used. Consequently, two different network connector assemblies have to be provided for networks using different data rates.

Figure 2A:
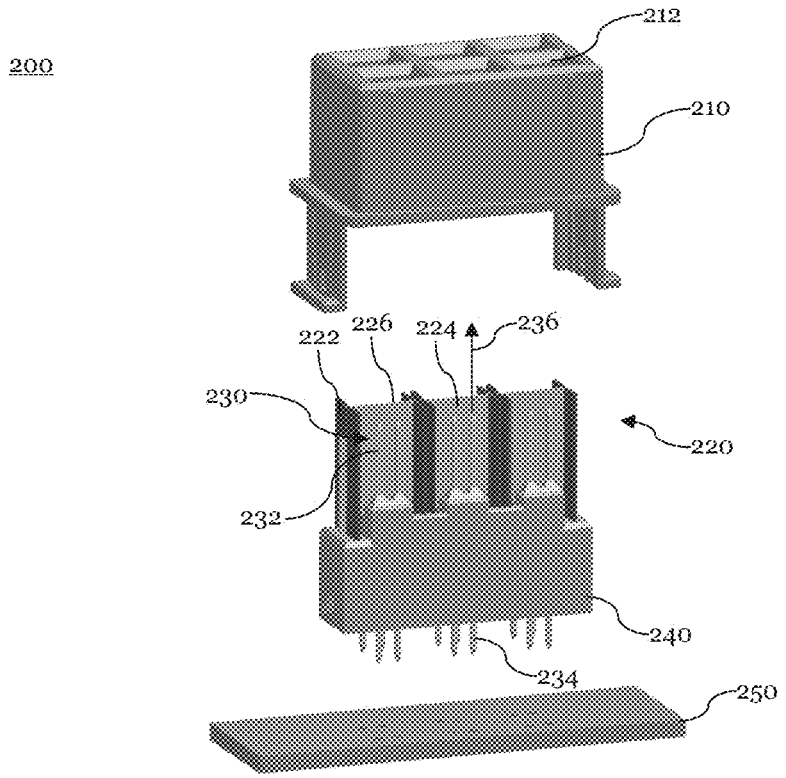
FIG. 2A is an exploded view of a linear network connector assembly.

FIG. 2A shows a network connector assembly having straight pins 232. Two pins 232 form a pin pair 230. In the embodiment shown, six pin pairs 230 are provided. The pins 232 of the pin pairs 230 are embedded in a header 240, wherein the header 240 is molded around the pins 232. Further, the pins 232 have a mating portion and a contact portion 234 that can be soldered to a PCB 250. The header is further provided with a shielding member 220, wherein the shielding member 220 has six first shielding plates 222 so that one pin pair 230 is provided between two first shielding plates 222. Further, a second shielding plate 224 is provided that is arranged between two rows of pin pairs 230. The shielding member 220 has a front face 226 that is oriented substantially normal to the mating direction 236. The header 240 can be protected with a header shroud 210, wherein the header shroud 210 is provided with openings 212 that are each configured to receive a pin pair 230.

Figure 2B:
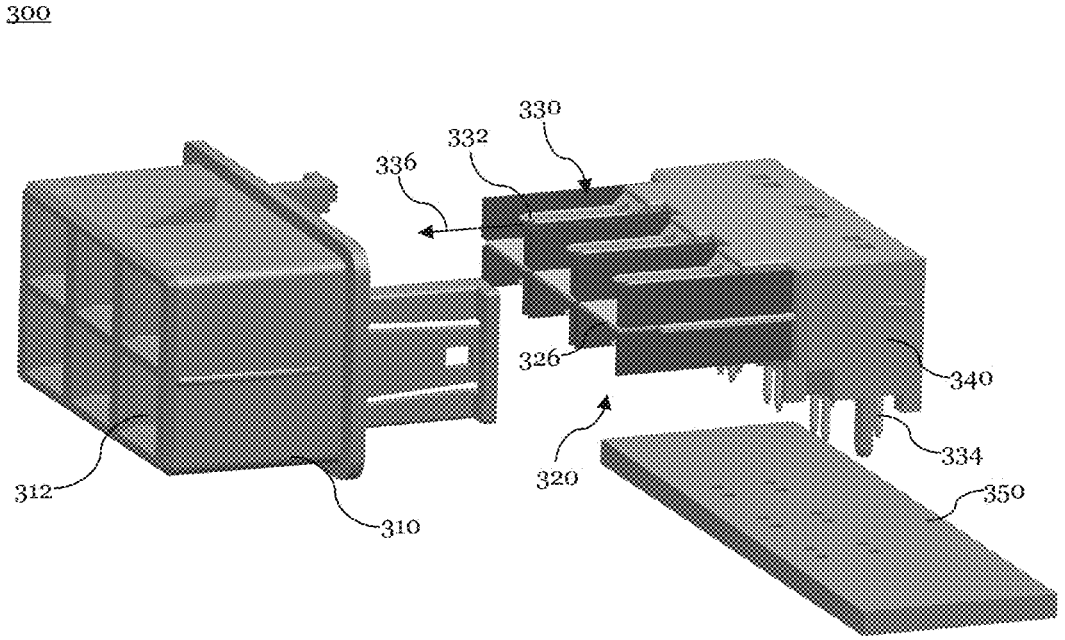
FIG. 2B is an exploded view of an angled network connector assembly.

In FIG. 2A, an angled network connector assembly 300 is shown. The angled network connector assembly has angled pins 332 that are angled at an angle of about 90°. Thus, the mating direction 336 and the contacting portion 334 of the pins 332 enclose an angle of about 90°. The network connector assembly of FIG. 2B includes six pin pairs being each formed of two pins 332. The pin pairs 330 are shielded on three sides by the shielding member 320. The shielding member 320 will be discussed in greater detail with respect to FIGS. 3A-3C and is provided with a front face 326 that is substantially normal to the mating direction 336. The header 340 can be covered by the header shroud 310, wherein the header shroud 310 includes openings 312 for receiving the pin pairs 330.

Figure 3A:
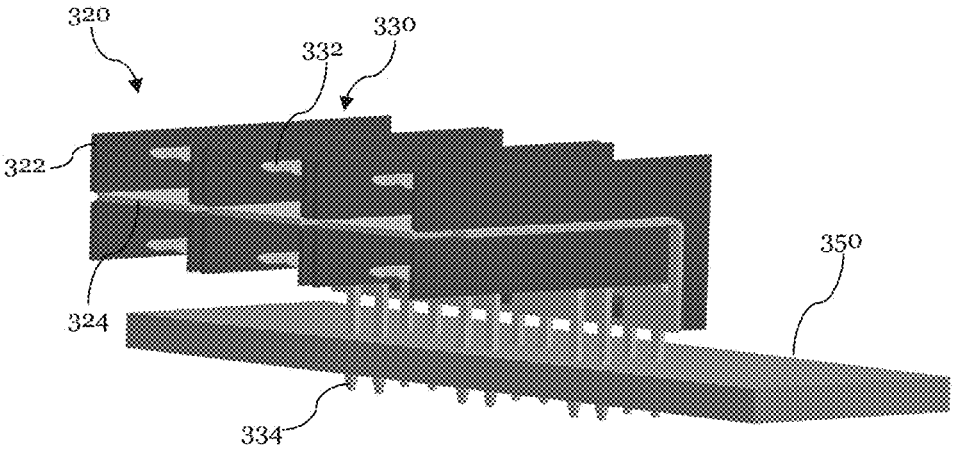
FIG. 3A is a schematic view of a shielding member, shielding pin pairs.
Figure 3B:
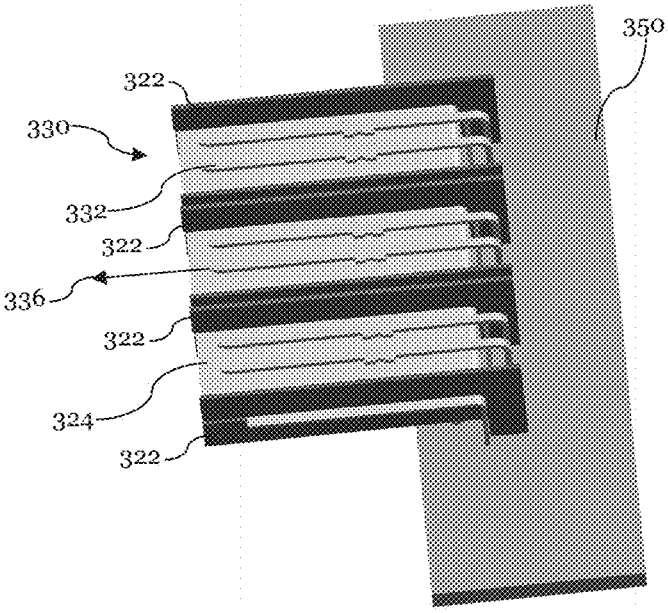
FIG. 3B is a schematic top view of the shielding member of FIG. 3A.

FIG. 3A shows the pin pairs and the shielding member 320 of the network connector assembly 300. As can be seen, the pins 332 of the pin pairs 330 are electrically conductively connected with their contacting portions 334 with the PCB 350. The shielding member 320 includes six first shielding plates 322, wherein a pin pair 330 is arranged between two adjacent shielding plates 322. Further, a second shielding plate 324 is provided, preferably centered, between the rows that are formed by pin pairs 330. The second shielding plate 324 is angled so that is follows the course of the pins 332. As can be seen in FIG. 3A, the shielding member 320 is assembled from six first shielding plates 322 and one second shielding plate 324. Alternatively, an integrally formed shielding member would be possible. As shown in FIG. 3B, the first shielding plates 322 extend beyond the second shielding plate 324 in a direction opposite to the mating direction 336. Further, the shielding member 320 does not contact the PCB 350 so that the header 340 can be molded or formed around the shielding member 320 to provide sufficient mechanical stability.

Figure 3C:
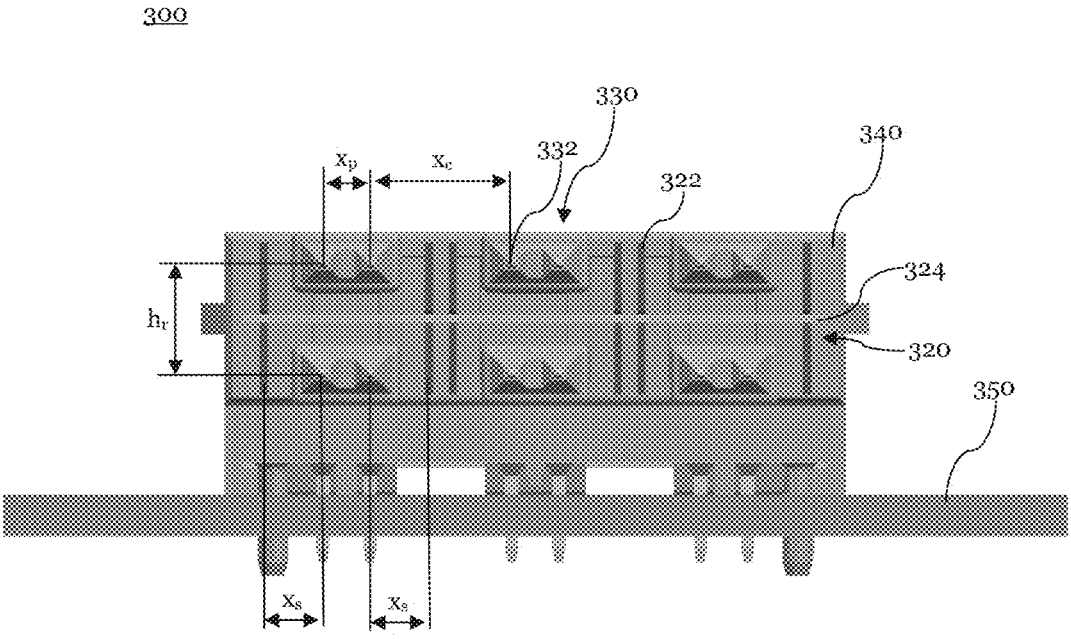
FIG. 3C is a schematic front view of the shielding member of FIGS. 3A and 3B with a header.

FIG. 3C shows a header 340 being provided with six pin pairs 330 and a shielding member 320 from a front view. The shielding member 320 includes six first shielding plates 322 that are oriented vertically. Further, a horizontally orientated second shielding plate 324 is provided centered between the rows of pin pairs 330. Thus, each pin pair 330 is shielded on three sides by the shielding member 320. The distance $x_p$ between two adjacent pins 332 of a pin pair 330 is preferably in the range of 1.4 mm to 2.1 mm. The distance $x_c$ between two adjacent pins 332 of different pin pairs 330 in a row is in the range of 5.0 mm to 6.5 mm. The distance $h_R$ between two adjacent pins 332 of different pin pairs 330 in a column is in the range of 3.3 mm to 5 mm. Further, the first shielding plates 322 are spaced apart from a corresponding pin of a pin pair by an equal distance $x_S$, wherein the distance $x_S$ is preferably at most 3.5 mm, even more preferably at most 3 mm and most preferably at most 2.5 mm. Thus, each pin has similar shielding properties.

Figure 4A:
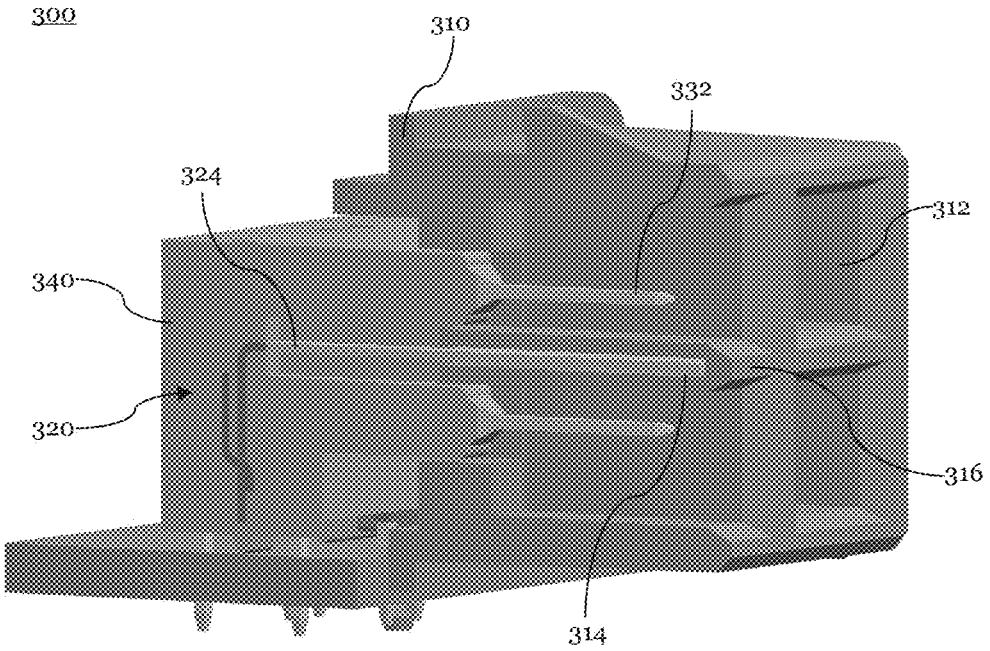
FIG. 4A is a schematic cut view of the network connector assembly.

FIG. 4A shows a schematic cut view of the network connector assembly 300, wherein the pins 332 are arranged within the header 340. The shielding member 320 is shown in a cut view, wherein the second shielding plate 324 is arranged horizontally. Preferably, the header 340 is molded around the shielding member 320. The header shroud 310 is provided on the header 340 to protect the shielding member 320 and the pins 332. The header shroud 310 is provided with a shielding cavity 314 configured to receive the shielding member 320. The front face 326 of the shielding member 320 is covered by the header shroud 310 and in particular by rib 316. Further, openings 312 are provided to receive the pins 332.

Figure 4B:
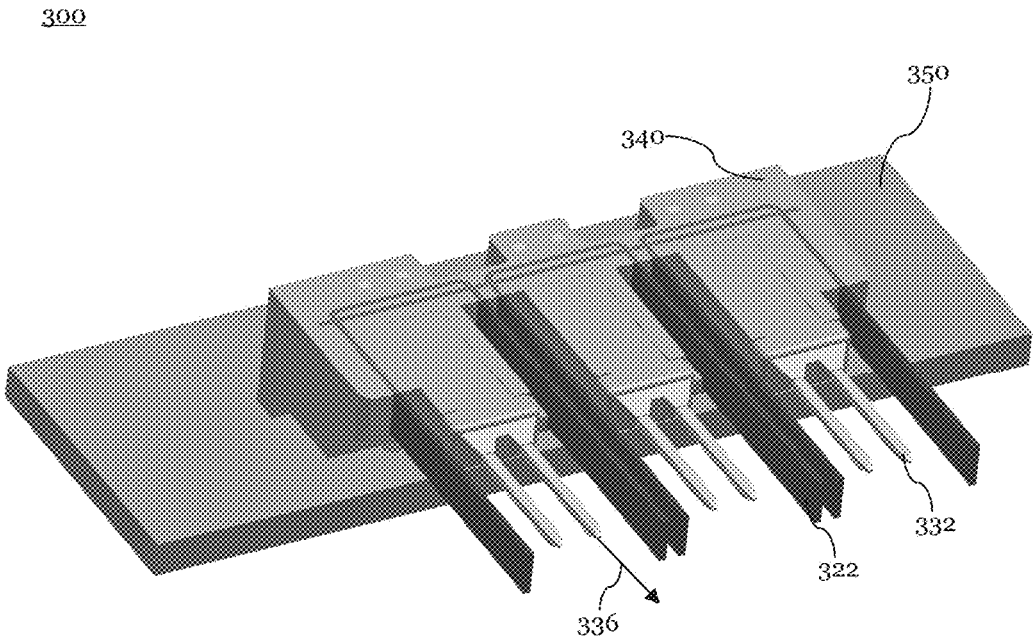
FIG. 4B is a schematic cut view of the network connector assembly.

FIG. 4B shows a horizontal cut view of the network connector assembly 300. As can be seen, the header 340 is molded around the pins 332 and the shielding members 320. Particularly, the first shielding plates 322 are entirely surrounded by the header 340 in the rear part so that an increased mechanical stability is achieved. Further, the first shielding plates 322 extend beyond the pins 332 in the mating direction 336.

Figure 5:
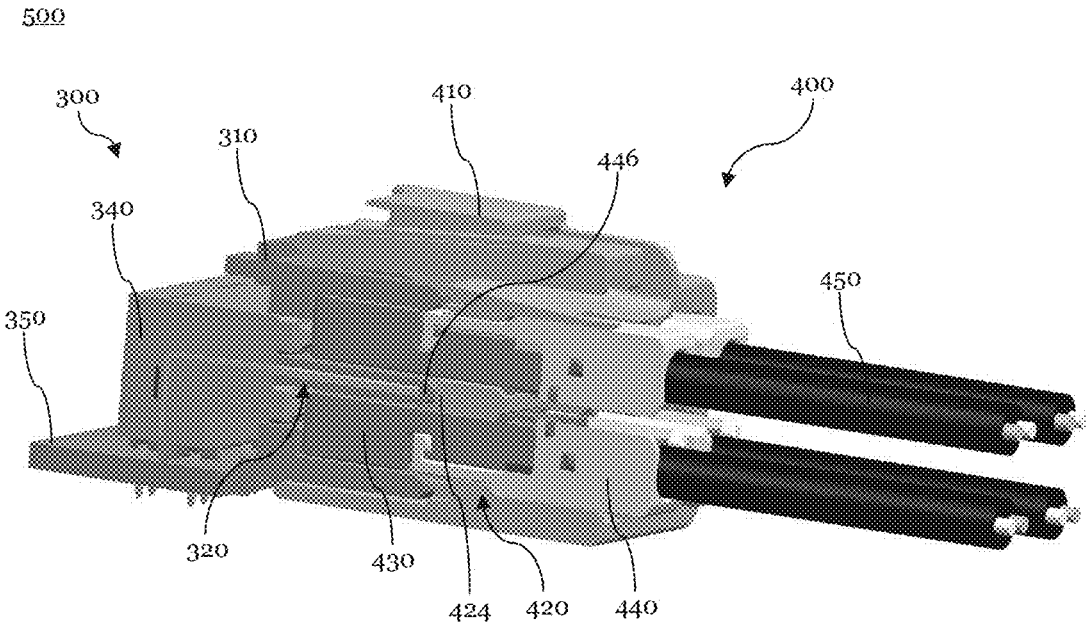
FIG. 5 is a schematic cut view of a network connector system.

FIG. 5 shows a network connector system 500 including a network connector assembly 300 and a counter connector assembly 400. The network connector assembly 300 includes a PCB 350, a header 340, a header shroud 310, wherein the shielding member 320 is received in the shielding cavity 314 of the header shroud 310. The counter connector assembly 400 includes a collector housing 410 that receives multiple counter connectors 430. The counter connectors 430 are provided with a counter connector shroud 440 and are coupled to wires 450. The collector housing 410 includes a counter shielding member 420 that is arranged within the collector housing 410, so that a gap 446 between the shielding member 320 and the counter shielding member 420 is formed when the network connector assembly 300 is mated with the counter connector assembly 400. This means that the shielding member 320 and the counter shielding member 420 do not overlap.

Figure 6A:
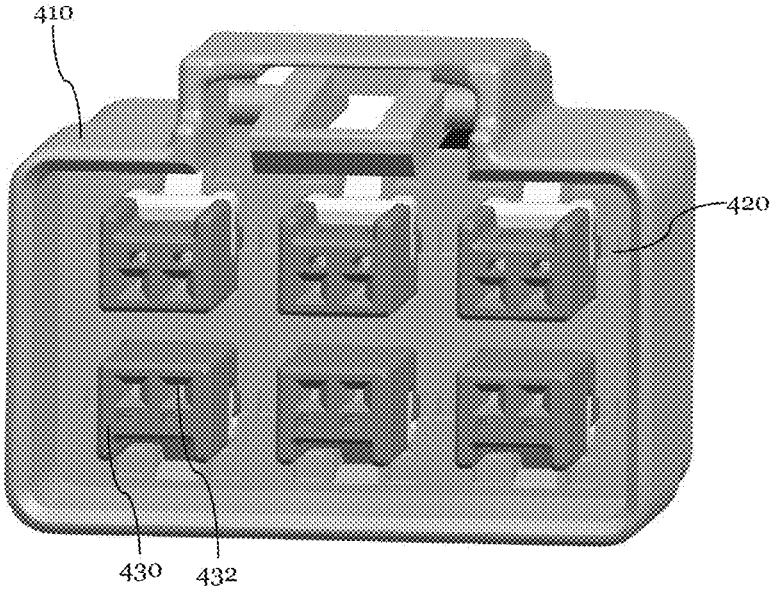
FIG. 6A is a schematic front view of a counter connector assembly.
Figure 6B:
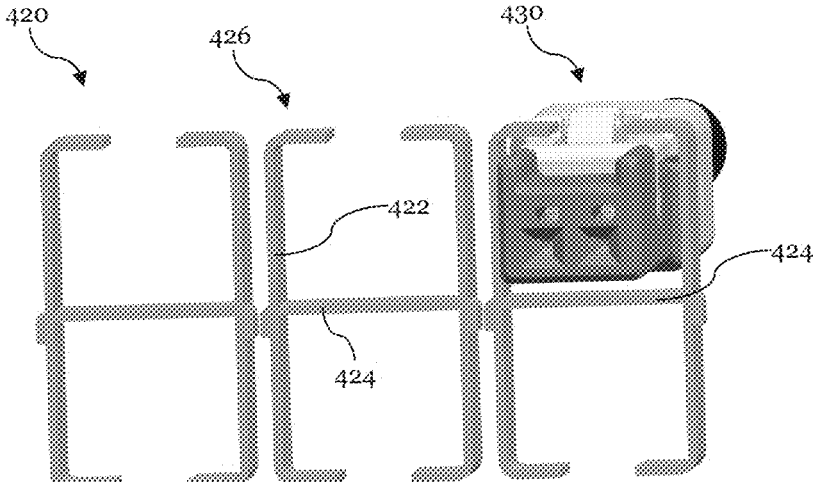
FIG. 6B is a schematic front view of a counter shielding member.

FIG. 6A shows a front view of the counter connector assembly 400, wherein the counter connector assembly 400 includes a collector housing 410 that receivers six counter connectors 430. The counter connectors 430 are provided with a pair of terminals 432. Within the collector housing 410 a counter shielding member 420 is provided, wherein the counter shielding member 420 is shown in greater detail in FIG. 6B.

The counter shielding member 420 includes in the preferred embodiment three shielding elements 426, wherein a shielding element 426 can receive two counter connectors 430. Each shielding element 426 includes two first shielding plates 422, wherein the first shielding plates 422 are shown in a vertical orientation. Further, second shielding plates 424 are provided that are shown in a horizontal orientation. First and second shielding plates 422, 424 shield the counter connector 430 on at least three sides.

Figure 7A:
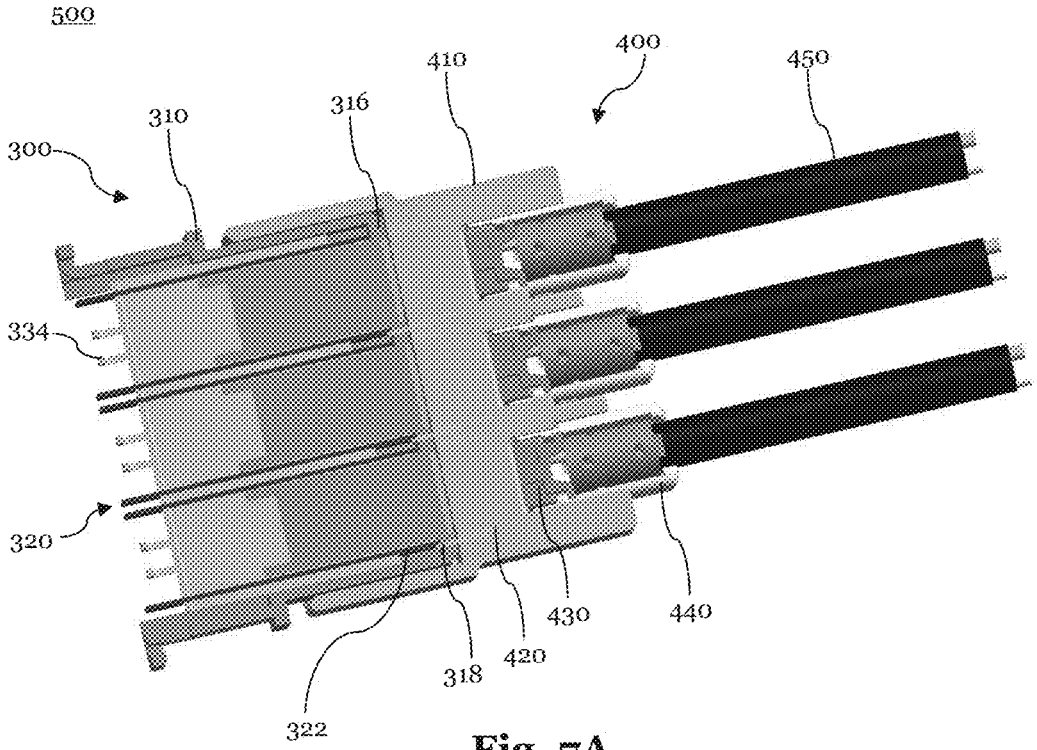
FIG. 7A is a schematic cut view of a network connector system.

In FIG. 7A, the network connector system 500 is shown in a cut view, including a network connector assembly 300 and a counter connector assembly 400. The shielding member 320 of the network connector assembly 300 is received in a shielding cavity 314 of the header shroud 310. The front face 326 of the shielding member 320 is covered by the rib 316 of the header shroud 310. Further, through openings 318 are provided within the shielding cavity 314 to allow electrically contact the counter shielding member 420 with the shielding member 320. Thus, a continuous shielding from the shielding member 320 over the counter shielding member 422 to the shield of the wires 450 can be provided to significantly reduce crosstalk.

Figure 7B:
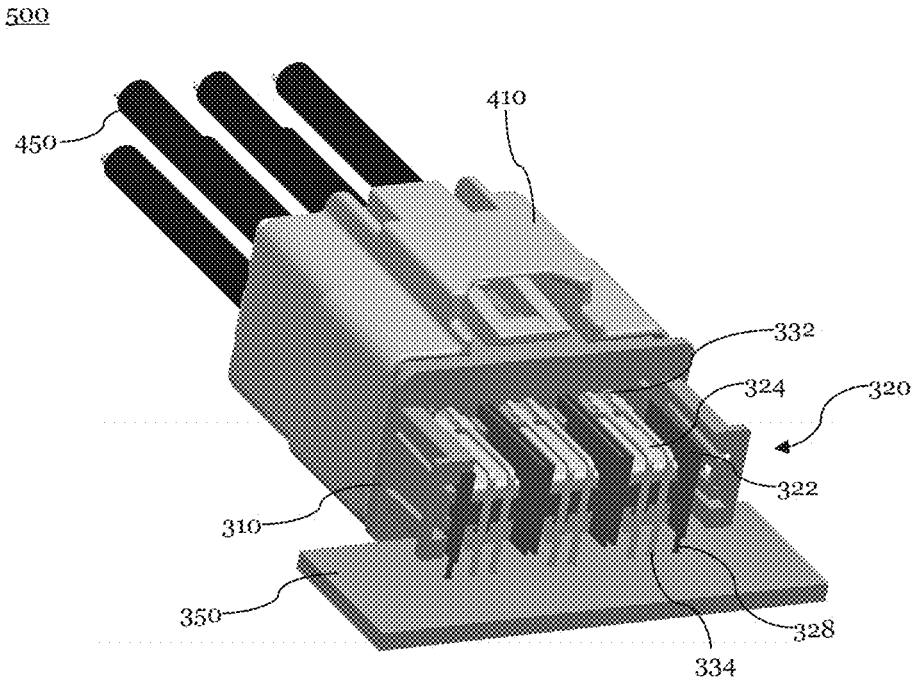
FIG. 7B is a schematic view of the network connector system, wherein the header is not shown.

FIG. 7B shows the network connector system 500, wherein the network connector system 500 includes the counter connector assembly 400 and the network connector assembly 300, wherein the header 340 is not shown. The shielding member 320 is provided with a contact member 328 and is electrically conductive contacted with the printed circuit board. Thus, the EMC properties of the network connector system 500 can be improved.

While this invention has been described in terms of the preferred embodiments thereof, it is not intended to be so limited, but rather only to the extent set forth in the claims that follow. Moreover, the use of the terms first, second, primary secondary, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

LISTING OF REFERENCE NUMBERS

110*a*/110*b* header shroud
150*a*/150*b* printed circuit board (PCB)
200 network connector assembly
210 header shroud
212 opening
220 shielding member
222 first shielding plate
224 second shielding plate
226 front face
230 pin pair
232 pin
234 contact portion
236 mating direction
240 header
250 printed circuit board (PCB)
300 network connector assembly
310 header shroud
312 opening
314 shielding cavity
316 rib
318 through opening
320 shielding member
322 first shielding plate
324 second shielding plate
326 front face
330 pin pairs
332 pin
334 contact portion
340 header
350 printed circuit board (PCB)
400 counter connector assembly
410 collector housing
420 counter shielding member
422 first counter shielding plate
424 second counter shielding plate
430 counter connector
432 terminal
440 counter shroud
450 wire
500 network connector system
$h_A/h_B$ distance between rows
$h_r$ distance between pins in a column
$x_A/x_B$ distance between columns
$x_C$ distance between pins in a row
$x_p$ distance between pins
$x_s$ distance between first shielding plate and pin

We claim:

1. A network connector assembly, comprising:

a header having two pins forming a pin pair, wherein the two pins extend in a mating direction;

an electrically conductive shielding member configured to shield the pin pair on two sides, wherein the shielding member has a front face that is oriented substantially normal to the mating direction; and a header shroud having a shielding cavity for receiving the shielding member, wherein the front face of the shielding member is partly covered by the header shroud, wherein the shielding member comprises two first shielding plates, wherein the pin pair is provided between the two first shielding plates so that the shielding member shields the pin pair on two sides, wherein each of the two first shielding plates is spaced apart from a corresponding pin of the pin pair by an equal distance that is at most 3.5 mm.

2. The network connector assembly according to claim 1, wherein the shielding member further comprises a second shielding plate and wherein the second shielding plate is configured to shield the pin pair on a third side.

3. The network connector assembly according to claim 2, wherein the second shielding plate is configured to shield the pin pair on a fourth side.

4. The network connector assembly according to claim 2, wherein the two first shielding plates extend beyond the second shielding plate in a direction opposite to the mating direction.

5. The network connector assembly according to claim 1, further comprising two pin pairs arranged in a row and wherein one of the two first shielding plates is arranged between two adjacent pin pairs so that the two first shielding plates are spaced apart from the corresponding pin of the pin pair by an equal distance.

6. The network connector assembly according to claim 1, further comprising multiple pin pairs arranged in rows and columns.

7. The network connector assembly according to claim 1, wherein the distance between the two pins of the pin pair is in a range of 1.4 mm to 2.1 mm, wherein the distance between two adjacent pins of different pin pairs in a row is in a range of 5.0 mm to 6.5 mm, and wherein the distance between two adjacent pins of different pin pairs in a column is in a range of 3.3 mm to 5.0 mm.

8. The network connector assembly according to claim 1, wherein the shielding member is integrally formed.

9. The network connector assembly according to claim 1, wherein the shielding member is formed of at least one selected from the list consisting of a metal sheet and an electrically conductive polymer.

10. The network connector assembly according to claim 1, wherein the header is molded on the shielding member and wherein the header is integrally formed with the header shroud.

11. The network connector assembly according to claim 1, wherein the shielding cavity is provided with a through hole for electrically connecting the shielding member of the network connector assembly with a counter shielding member of a corresponding counter connector assembly upon mating the network connector assembly with the corresponding counter connector assembly.

12. The network connector assembly according to claim 1, wherein the network connector assembly is mounted on a printed circuit board and wherein the shielding member comprises a contacting member for electrically conductive contacting the shielding member with the printed circuit board.

13. A counter connector assembly configured to be mated with the network connector assembly of claim 1, said counter connector assembly comprising:

a counter connector having two contact terminals;

a collector housing, being configured to receive the counter connector;

an electrically conductive counter shielding member, wherein the counter shielding member is arranged within the collector housing so that the counter connector is shielded on two sides by the counter shielding member; and a shielding element, wherein the shielding element comprises two first counter shielding plates, wherein the counter connector is positioned between the two first counter shielding plates so that the shielding element shields the counter connector on two sides, wherein the shielding element further comprises a second counter shielding plate, and wherein the second counter shielding plate shields the counter connector on a third side.

14. The counter connector assembly according to claim 13, wherein the second counter shielding plate shields the counter connector on a fourth side.

15. The counter connector assembly according to claim 13, wherein the counter shielding member comprises a metal sheet and/or an electrically conductive polymer, and wherein the shielding element and/or the counter shielding member is integrally formed.

* * * * *